United States Patent [19]

Gagas

[11] 4,368,893

[45] Jan. 18, 1983

[54] MANHOLE INFILTRATION DISK AND SEAL ASSEMBLY

[76] Inventor: Stanley Gagas, 127 Alpine Ter., Shawano, Wis. 54166

[21] Appl. No.: 301,029

[22] Filed: Sep. 10, 1981

[51] Int. Cl.[3] ..... F16J 15/10; E02D 29/14

[52] U.S. Cl. ..... 277/12; 277/101; 277/180; 404/25

[58] Field of Search ..... 277/12, 32, 101, 180; 404/22–26

[56] References Cited

U.S. PATENT DOCUMENTS

| | | | |
|---|---|---|---|
| 2,937,037 | 5/1960 | Woolsey | 277/101 X |
| 3,621,623 | 11/1971 | Downes | 404/25 |
| 3,930,656 | 1/1976 | Jelinek | 277/180 |
| 3,973,856 | 8/1976 | Jaglioti | 404/25 |
| 4,101,236 | 7/1978 | Meyer | 404/25 |
| 4,203,686 | 5/1980 | Bowman | 404/25 |

FOREIGN PATENT DOCUMENTS

| | | | |
|---|---|---|---|
| 1477551 | 3/1967 | France | 277/180 |
| 862388 | 3/1961 | United Kingdom | 404/25 |
| 864547 | 4/1961 | United Kingdom | 404/25 |

*Primary Examiner*—Robert S. Ward, Jr
*Attorney, Agent, or Firm*—Ronald E. Barry

[57] ABSTRACT

A manhole infiltration disk and seal assembly including a circular plate having flanges on the inner and outer peripheral edges and a strip of compressible seal material on the top and bottom surface, the disk being adapted to be placed between the top of a manhole and the bottom of a manhole cover assembly to form a seal and a seal assembly for sealing the spaces between spacer rings when placed on the manhole.

7 Claims, 7 Drawing Figures

MANHOLE INFILTRATION DISK AND SEAL ASSEMBLY

BACKGROUND OF THE INVENTION

Manholes are commonly closed by manhole cover assemblies which are placed directly onto the top of the manhole and then embedded in concrete or asphalt. The weight of the manhole assembly is used to hold the manhole cover in position on top of the manhole. No seal is provided other than the weight of the manhole assembly. Over a period of time erosion of the asphalt or concrete will allow water to infiltrate into the manhole through the space between the cover and the top of the manhole. Excessive amounts of water infiltrating the manhole produces an increased burden on the sewer system.

SUMMARY OF THE INVENTION

The present invention is concerned with an infiltration disk and seal assembly which is used to prevent infiltration of water into the sewer system. The infiltration disk is placed on the manhole and the manhole assembly placed on top of the infiltration disk to produce a seal between the manhole and the manhole cover. Flanges are provided around the inner and outer periphery of the infiltration disk to hold the manhole cover in position on top of the manhole. A seal assembly is used to seal the gap between the manhole and manhole assembly when spacer rings are used to raise the manhole assembly to ground level.

THE DRAWING

DETAILED DESCRIPTION OF THE INVENTION

Figure 2:
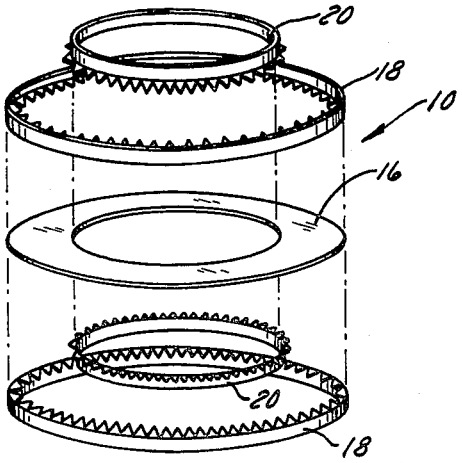
FIG. 2 is an exploded perspective view of the infiltration disk.
Figure 1:
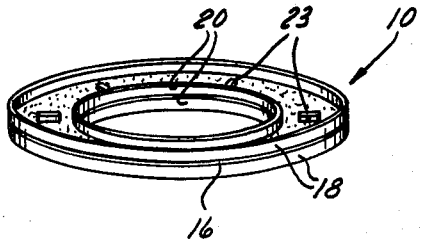
FIG. 1 is a perspective view of an infiltration disk according to the invention.
Figure 3:
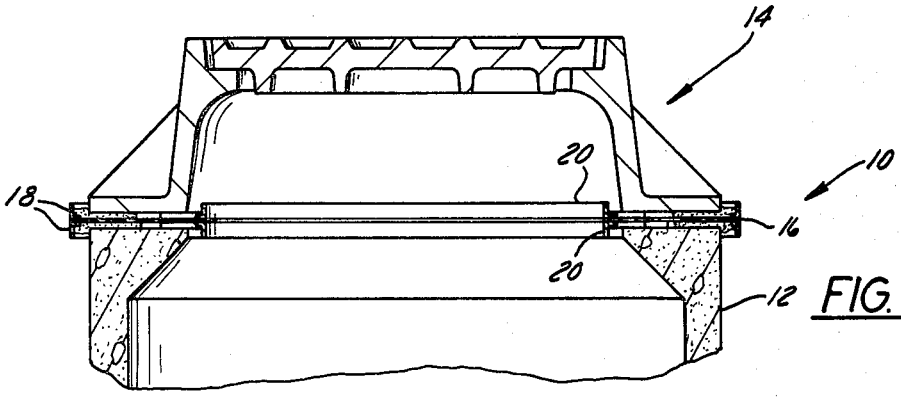
FIG. 3 is a section view in elevation showing the infiltration disk placed between the manhole and the manhole cover assembly.

The infiltration disk 10 as seen in FIGS. 1 through 4 is used to seal the space between the top of a manhole 12 and the bottom of a manhole assembly 14 which includes a manhole frame 15 and a cover 17. The infiltration disk generally includes a ring 16 made of 22 gauge iron. Outer peripheral bands 18 are welded to the top and bottom of the disk 16 to form a flange around the outer perimeter of the disk 16. Inner peripheral bands 20 are welded to the top and bottom of the disk to form a flange around the inner perimeter of the disk 16. The disk 16 and flanges 18 and 20 can be coated with a rust protection material such as Ziebart to increase the life of the infiltration disk.

Means are provided on the top and bottom of the disk 16 to form a compressible seal when the manhole cover assembly is placed on the manhole. Such means is in the form of a highly refined asphalt strips 22 having a volatile solvent and an inorganic asbestos filler. The strips 22 are placed on the top and the bottom of the infiltration disk. The material for the strips must meet federal specification SS-C-153B and is manufactured by W. R. Meadows, Inc., of Elgin, Ill. under the trademark "Seal Tight." This material will gradually harden after it has been placed in position to form a tough elastic seal between the infiltration disk 10, the manhole, and the frame 15 of the manhole assembly 14.

Figure 4:
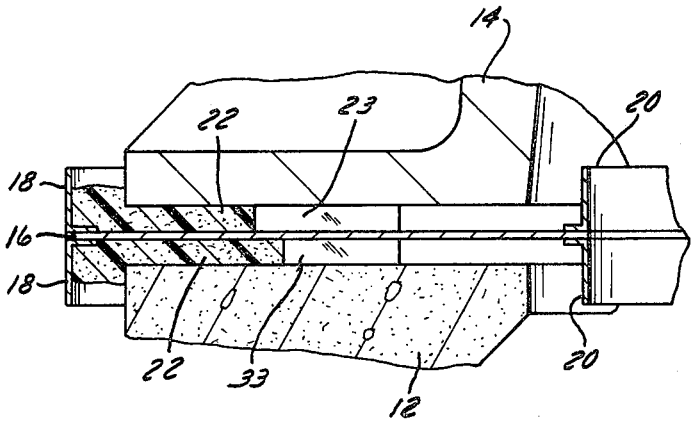
FIG. 4 is an enlarged view of a portion of FIG. 3 showing the seal provided by the infiltration disk.

As seen in FIG. 4, the Seal Tight compound 22 is squeezed by the weight of the manhole cover assembly outwardly toward the flange 18. The Seal Tight compound thus filling the space around the outer periphery of the frame 15 and the manhole 12 to prevent infiltration of water or other contaminants. Means can be provided on the disk to prevent the seal from being squeezed entirely from the disk. Such means is in the form of a number of spacers 23 located on the tops and bottoms of the disk.

Figure 5:
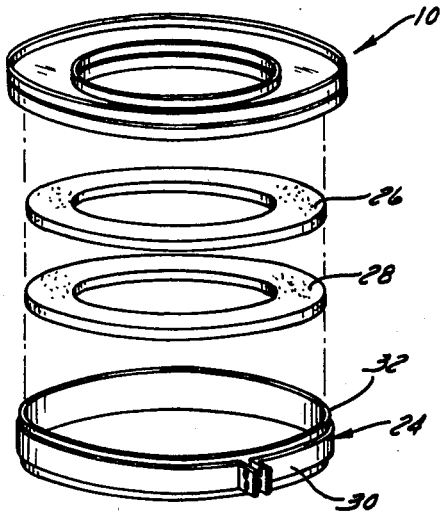
FIG. 5 is a view of an infiltration disk used in combination with a seal ring assembly.
Figure 6:
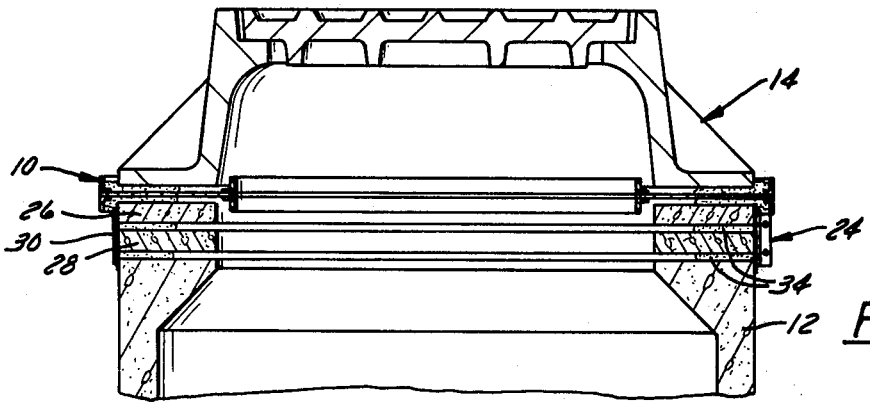
FIG. 6 is a view in elevation showing the infiltration disk and seal assembly sealing a manhole assembly mounted on spacer rings provided on the top of the manhole.
Figure 7:
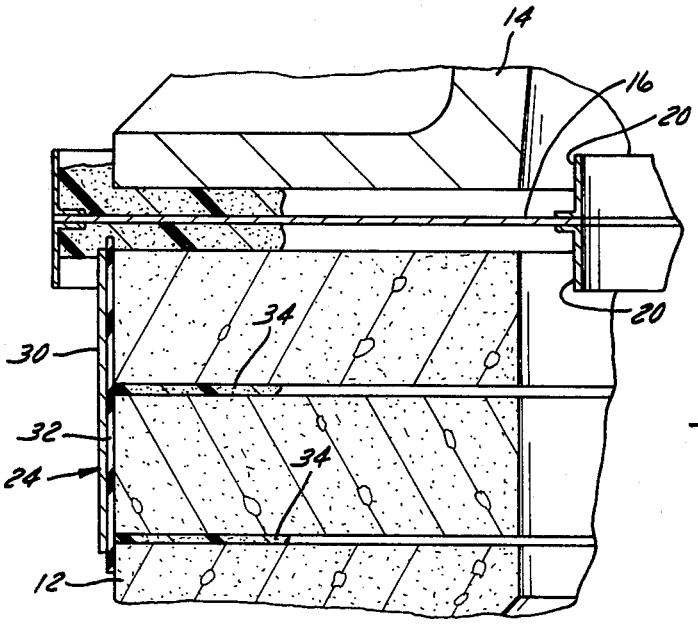
FIG. 7 is an enlarged view of a portion of FIG. 6 showing the seals between spacer rings.

Referring to FIGS. 5, 6, and 7, another embodiment of the present invention is shown wherein the infiltration disk 10 is used in combination with a seal assembly 24 to seal the spaces between spacer rings 26 and 28 provided between the frame 17 and manhole 12. In this regard whenever the level of the street exceeds the distance between the top of the manhole 12 and the height of the manhole cover assembly 14, spacer rings are used to make up the difference. As seen in FIG. 6, two spacer rings 26 and 28 are shown mounted on the top of the manhole 12. The infiltration disk 10 is positioned on the top of the top spacer ring 26 and the manhole cover assembly 14 placed on the infiltration disk.

The spaces between the spacer rings are sealed by means of the assembly 24 which includes a band 30 and a rubber ring 32 and compressible seal strips 34. The strips 34 are placed between the bottom spacer ring 28 and the manhole 12 and the top spacer ring 26 and the bottom spacer ring 28. The rubber ring 32 is placed around the outer periphery of the spacer rings to hold the seal strips in the space between the spacer rings. The band 30 is tightened against the rubber ring 32. When the manhole cover assembly 14 is placed in position on top of the spacer rings, the weight of the manhole cover assembly will squeeze the compressible seal strips 34 outward from the spaces between the rings and the top of the manhole. The seal strips 34 will be retained in the spaces between the spacer rings 26 by the band 32.

I claim:

1. A manhole infiltration disk adapted to be positioned between a manhole and a manhole cover assembly, said disk comprising a flat circular plate having an open center, a first flange secured to the outer periphery of said plate, a second flange secured to the inner periphery of said circular plate, said circular plate having an outside diameter greater than the outside diameter of said manhole cover assembly and an inside diameter less than the inside diameter of said manhole cover assembly whereby said manhole cover assembly is restricted from lateral movement with respect to the manhole.

2. The infiltration disk according to claim 1 including compressible seal means for sealing the space between the infiltration disk, the manhole cover assembly, and the manhole.

3. A manhole infiltration disk assembly comprising an infiltration disk adapted to be mounted between a manole cover assembly and a manhole and a compressible seal member provided on the top and bottom of said disk whereby the weight of the manhole cover will spread the seal member into the space between the infiltration disk, the manhole cover assembly, and the manhole.

4. The assembly according to claim 3 wherein said disk includes a circular plate having flanges around the inside and outside diameters of said plate, said flanges being located a distance apart equal to or greater than the width of the base of the frame of a manhole cover assembly.

5. The assembly according to claim 3 including means for preventing the seal member from being squeezed out of the disk.

6. An infiltration system for sealing the gap between a manhole, spacer rings, and manhole cover assembly, said system including a rubber band having a width sufficient to overlap the gaps between the manhole and the spacer rings, a compressible seal means positioned in the gaps between the seal rings and the manhole, and means for tightening the band against the outer periphery of the manhole and spacer rings to hold the seal member in the space between the rings, an infiltration disk positioned between the manhole cover assembly and the top spacer ring, and a compressible seal member on the top and bottom of the disk to provide a seal between the manhole cover assembly and the top spacer ring.

7. The system according to claim 6 including means for maintaining a space between the disk, manhole cover and manhole for the seal member.

* * * * *